US005358146A

United States Patent [19]

Stull

[11] Patent Number: 5,358,146

[45] Date of Patent: Oct. 25, 1994

[54] HAND-HELD DISPENSER WITH TWIST-TO-OPEN CAP

[76] Inventor: Gene Stull, 1 Winston Farm La., Far Hills, N.J. 07931

[21] Appl. No.: 139,087

[22] Filed: Oct. 21, 1993

[51] Int. Cl.[5] ..... B65D 47/00

[52] U.S. Cl. ..... 222/148; 222/548

[58] Field of Search ..... 222/548, 553, 555, 531, 222/532, 519, 148

[56] References Cited

U.S. PATENT DOCUMENTS

| | | | |
|---|---|---|---|
| 2,808,971 | 10/1957 | Vurdelja | 222/548 |
| 2,849,166 | 8/1958 | Eitzel | 222/519 |
| 3,029,003 | 4/1962 | Gronemeyer | 222/548 X |
| 3,118,578 | 1/1964 | Collins | 222/548 |
| 3,258,179 | 6/1966 | Cherba | 222/553 X |
| 3,261,513 | 7/1966 | Moran | 222/553 X |
| 3,317,093 | 5/1967 | Moran | 222/548 X |
| 3,342,385 | 9/1967 | Knight | 222/548 X |
| 3,357,605 | 12/1967 | Chadfield | 222/548 X |
| 4,424,918 | 1/1984 | Stull | 222/153 |
| 4,438,870 | 3/1984 | Stull | 222/48 |
| 4,444,328 | 4/1984 | Glass | 222/548 X |
| 4,477,002 | 10/1984 | Stull | 222/521 |
| 4,570,825 | 2/1986 | Stull | 222/45 |
| 4,625,899 | 12/1986 | Stull | 222/521 |
| 4,646,947 | 3/1987 | Stull | 222/397 |
| 4,646,949 | 3/1987 | Stull | 222/521 |
| 4,754,899 | 7/1988 | Stull | 222/521 |
| 4,826,055 | 5/1989 | Stull | 222/524 |
| 4,842,169 | 6/1989 | Stull | 222/521 |
| 4,961,515 | 10/1990 | Schreiber | 222/553 X |
| 5,044,530 | 9/1991 | Stull | 222/521 |
| 5,090,598 | 2/1992 | Stull | 222/153 |
| 5,284,273 | 2/1994 | Schreiber | 222/519 X |

FOREIGN PATENT DOCUMENTS

| | | | |
|---|---|---|---|
| 1389433 | 4/1975 | United Kingdom | 222/553 |
| 2041739 | 9/1980 | United Kingdom | 222/553 |

*Primary Examiner*—Kevin P. Shaver
*Attorney, Agent, or Firm*—H. Gibner Lehmann; K. Gibner Lehmann

[57] ABSTRACT

A hand-held dispenser for holding and dispensing various grooming, household, cosmetic and the like liquids features only two parts to effect a turn-to-open-or-close function. A plastic bottle or container part has an integral neck portion for discharge of the contents of the container. The bore of the neck portion is so formed that it provides a valving action in conjunction with a turnable cap part that is carried by the neck. Adjustable positioning of the cap part on the neck portion enables different rates of flow to be had from the container part.

10 Claims, 1 Drawing Sheet

HAND-HELD DISPENSER WITH TWIST-TO-OPEN CAP

BACKGROUND OF THE INVENTION

Field of the Invention

Description of the Related Art Including Information Disclosed Under 37 CFR §§1.97–1.98

This invention relates generally to hand-held dispensers having captive closure caps.

The following patents are cited as being of interest, and together with the citations made against each, as well as the patents noted in the respective preambles, are considered to be a sampling of prior, known closure cap constructions:

U.S. Pat. Nos.

| | | |
|---|---|---|
| 4,424,918 | 4,438,870 | 4,477,002 |
| 4,570,825 | 4,625,899 | 4,646,947 |
| 4,646,949 | 4,754,899 | 4,826,055 |
| 4,842,169 | 5,044,530 | 5,090,598 |

With specific reference to the above identified 12 patents, U.S. Pat. No. 4,424,918 relates to a twist cap construction having an upstanding sealing plug (120) that is receivable in the bore (78) of a twist cap. The cap rides up a cam track (82) as it is manually unscrewed.

U.S. Pat. No. 4,438,870 discloses a somewhat similar twist cap, having a discharge opening (20) that is sealed off by an upstanding stopper (24) on a base cap.

U.S. Pat. No. 4,477,002 illustrates a twist cap construction having an internal cam track (40) and a cam follower lug (42) on the underside of the cap, which rides up the track as the cap is unscrewed. An especially neat, finished appearance is realizeable, since the cam track and follower are completely concealed during use of the dispenser.

U.S. Pat. Nos. 4,646,947 and 4,625,899 disclose screw caps applied to the neck of a container, and wherein provision is made for venting of gas from the container in its closed position, thereby preventing build up of pressure, and possible bursting or squirting of the container contents.

U.S. Pat. No. 4,646,949 illustrates a screw cap having a base part with a cam track, and wherein there is an abutment shoulder (68) at the lower end of the cam track, which functions as a detent for an internal cam follower lug (38, 40), to prevent inadvertent unscrewing movement of the cap prior to use.

U.S. Pat. No. 4,826,055 discloses a cap construction which is especially adapted to attain a relatively high flow-rate of the container contents during their intended discharge, made possible by the provision of a plurality of internal flow-enhancing channels or grooves on the inner surface of the base cap neck, and on the inner surface of the cap, the latter being of the push-pull variety.

U.S. Pat. No. 4,570,825 illustrates a twist-to-open cap having a cam track and follower lug, and a tamper-evident strip carried by the cap, and sonically welded to the base cap. Initial unscrewing of the cap results in breakage of the web, and axially-outward movement of the cap, to an open position.

U.S. Pat. Nos. 4,754,899 and 4,842,169 disclose screw cap constructions involving internal valving wall structures and flow passages, respectively on a base cap and twist cap, to enable control of the flow rate by means of "dialing", or turning the twist cap to a predetermined position on the base cap. A metering-type control function is thus achievable.

U.S. Pat. No. 5,044,530 relates to a twist cap construction having an internal, turnable twist-peg that rotates with the cap and selectively seals or opens a discharge passage therein. The slitted configuration of the discharge passage in the cap gives rise to a "ribbon" characteristic to the product being discharged, especially if the latter is somewhat viscous, as in the case of a cream, or a thick, liquid product.

Finally, U.S. Pat. No. 5,090,598 relates to a twist-to-open dispenser having a cap with a concealed cam track that cooperates with an internal cam lug on a container neck, in order to effect axial raising and lowering of the cap, corresponding to open and closed conditions of the dispenser, respectively.

It is noted that many of the above identified constructions have enjoyed considerable commercial success, due to their innovative design, and practicality of manufacture from the molding standpoint.

However, efforts to reduce manufacturing costs are always of concern today, considering the competitive nature of the marketplace, especially with consumer products intended to be manufactured and sold.

In keeping with this goal of reduced cost, efforts are continuously under way for devising simplified closure cap constructions that are either less expensive as a consequence of being more easily molded in quantity, or by virtue of the use of fewer parts.

One way to simplify molding is to place less reliance on screw-type caps, and instead employ fitted components that can be easily snapped into position and held by cooperable retainer structures thereon.

SUMMARY OF THE INVENTION

Accordingly it is an object of the present invention to provide a novel and improved twist-to-open closure cap construction which is extremely simple in its structure, being constituted of essentially a single component that is receivable on the neck of a container and held thereon by cooperable retainer elements on the neck and cap.

Still another object of the invention is to provide an improved closure cap construction in accordance with the foregoing, which is especially inexpensive to manufacture and assemble.

Yet another object of the invention is to provide an improved closure cap construction of the type noted, which is essentially completely devoid of screw thread structures, thereby reducing overall cost, and eliminating potential problems with solidified product becoming encrusted on or trapped between such threads.

Yet a further object of the invention is to provide an improved closure cap construction as outlined above, which is largely resistant to clogging due to product accumulation, thereby facilitating satisfactory operation for the consumer, over extended periods of time.

A still further object of the invention is to provide an improved closure cap construction as above characterized, which is especially easy to use, involving in a preferred embodiment, a simple twist operation through a fractional part of a turn, in order to selectively open or close off the discharge opening of the dispenser.

Still another object of the invention is to provide an improved closure cap construction of the kind indicated, wherein an especially neat and pleasing external appearance is realized, resulting in eye-catching appeal that enhances the marketability of the dispenser.

Yet another object of the invention is to provide an improved closure cap construction as above set forth, which is highly resistant to inadvertent leakage, resulting in reliable operation over extended periods of use.

The above objects are accomplished by a hand-held dispenser for holding and dispensing grooming liquids, household and cosmetic liquids and the like, comprising in combination a container having a neck defining a bore through which liquid contents of the container are to be discharged, the neck bore having a lower smooth-surfaced bearing portion and having an upper discharging portion provided with a discharge passage, and a cap turnably mounted on and having a depending outer skirt surrounding the neck of the container. The cap has a tubular valving portion disposed inside the outer skirt and which extends into the container neck with a snug sliding fit therein within the bearing portion. The valving portion has a discharge passage communicating with the interior of the container and adapted to move into and out of registration with the discharge passage of the container neck bore when the cap is turned on the container neck. Further, the cap has an orifice which aligns with the discharge passage of the neck bore when both of the discharge passages are in registration with each other. There are further provided cooperable stop means on the exterior of the container neck and the interior of the cap skirt, limiting the turning movement of the cap between sealing and discharge positions. Cooperable retainer means on the cap skirt and container neck are provided, adapted to bypass each other when the cap is forced axially over the neck so as to retain the cap on the neck.

The above objects are further accomplished by a hand-held dispenser for holding and dispensing liquids, comprising in combination a container having a neck with a bore through which liquid contents of the container are to be discharged, a cap for the container, and means on the container and cap for mounting the latter for solely turning movement on the neck of the container, the mounting means restraining the cap against any substantial axial movement on the container neck. The cap has a discharge orifice, and a stopper plug extending into the container neck. Cooperable valving means are provided on the stopper plug and on the neck of the container, for establishing communicating between the discharge orifice of the cap and the interior of the container when the cap is turned toward a first position on the container neck, and for blocking communication between the discharge orifice of the cap and the interior of the container when the cap is turned toward a second position on the container neck. The mounting means includes cooperable abutment structures adapted to bypass each other when the cap is forced axially over the neck so as to retain the cap on the neck.

The arrangement is such that an especially simple twist motion imparted to the cap results in its movement between a closed sealing position, and an open discharge position. No screw threads are involved. Nor does any axial movement of the cap occur, as in the case with conventional threaded closure constructions.

Simplified manufacturing, economy, and reliability in use are thus achievable.

Other features and advantages will hereinafter appear.

DESCRIPTION OF THE PREFERRED EMBODIMENT

Figures 1, 2, 3, 4, 5, 6, 7, 8, 9:
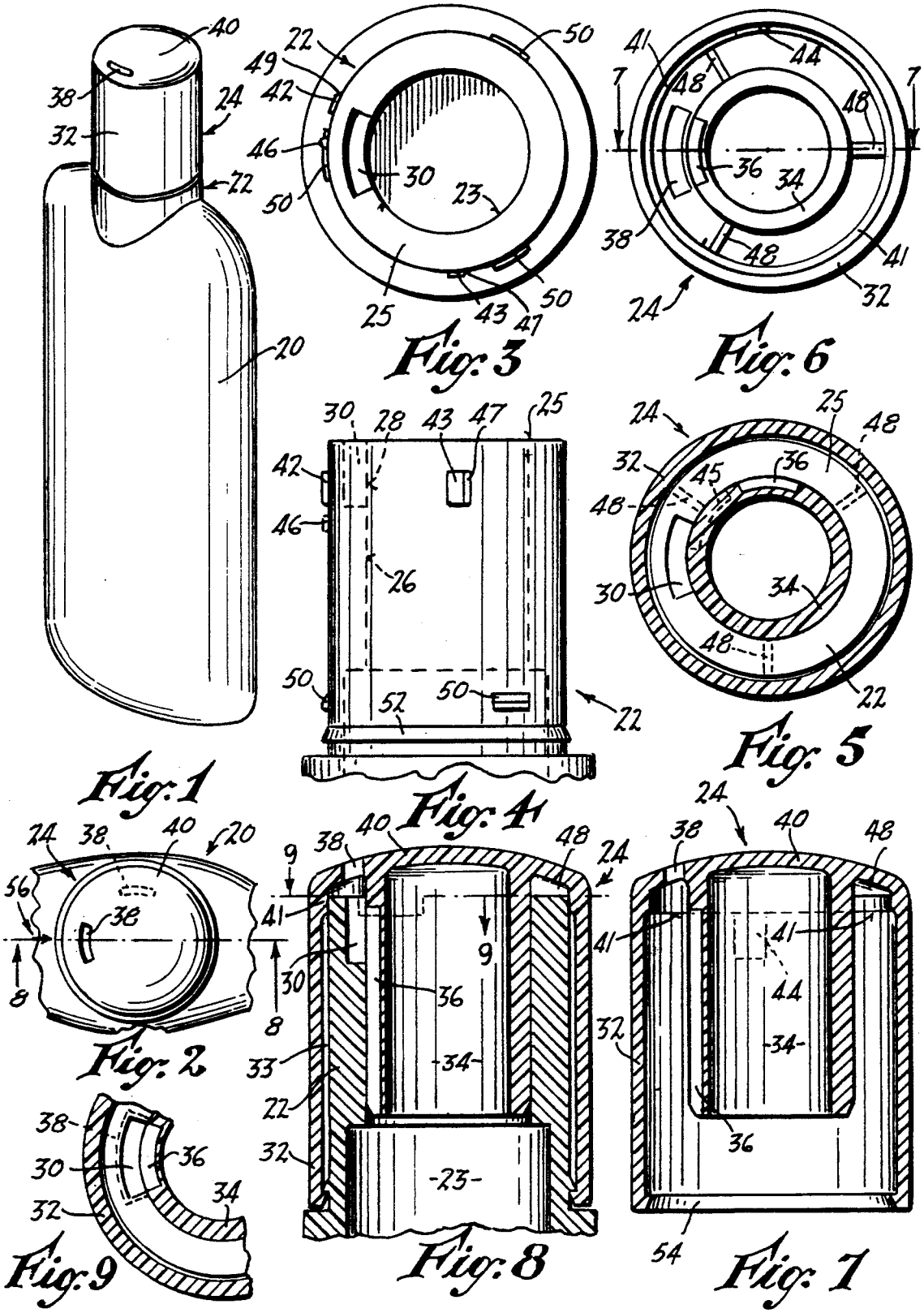
FIG. 1 is a perspective view of a plastic squeeze bottle and turnable cap movable solely in a single horizontal plane or zone on the neck of the bottle.
FIG. 2 is a fragmentary top plan view of the bottle and cap of FIG. 1.
FIG. 3 is a top plan view of the neck portion of the squeeze bottle of FIGS. 1 and 2.
FIG. 4 is a side elevational view of the neck portion of the squeeze bottle.
FIG. 5 is a horizontal sectional view of the assemblage of bottle and cap with the latter in its closing, sealing position. The section is taken in a horizontal plane located just above the top surface of the bottle neck.
FIG. 6 is a bottom plan view of the dispensing cap per se.
FIG. 7 is an axial sectional view taken on the line 7—7 of FIG. 6.
FIG. 8 is an axial sectional view taken on the line 8—8 of FIG. 2.
FIG. 9 is a fragmentary horizontal section taken on the line 9—9 of FIG. 8.

Considering first FIGS. 1–4, the two-piece hand-held liquid dispenser of the present invention is constituted of yieldable or resilient molded plastic, and is seen to comprise a unique combination of integral container and neck part constituting one portion of a valving means, and cooperable integral rotary sealing and dispensing cap part that turns on the container neck with no translational or axial movement at any time, and which constitutes another portion of the valving means. In the embodiment illustrated, this unique combination essentially comprises a squeeze bottle part 20 having an integral neck portion 22 provided with a cylindrical two-step bore configuration 23, said neck portion carrying a turnable cap part 24 that has no operative axial or translational movement but instead turns with true rotary motion about its axis, which coincides with the vertical axis of the bottle neck portion 22. The neck portion 22 has a flat circular top surface 25 which also functions as a bearing surface, as will later be described.

The smaller-diameter upper area of the bore 23 constitutes a bearing and valving surface, and this upper area has lower and upper portions 26 and 28 as shown in FIG. 4, the lower portion 26 being wholly smooth-surfaced and thus being adapted to constitute a sealing surface, whereas the upper portion 28 has a discharge passage or recess 30 for egress of liquid from the container 20.

The molded plastic cap 24 has a depending outer skirt 32 which surrounds an inner cylindrical valving portion 34 that is provided with a liquid discharge groove or recess 36 adapted to be either aligned with, or else misaligned with respect to the discharge passage 30 in the bottle neck 22. Between the skirt 32 and the neck portion 22 is an annular space 33, as shown. The valving portion 34 has a close sliding or bearing fit in the upper or small-diameter surfaces 26 and 28 of the bore 23, as shown in FIGS. 5 and 8, for example. The valving portion 34 is hollow, and fits the neck bore 23 in the manner of a stopper plug. The plug and annular skirt 32 form an inverted annular well, which receives the neck portion 22.

As seen in FIGS. 1, 2 and 6–8 the cap part 24 has a discharge orifice 38 in its upper transverse wall or crown 40, which is disposed in alignment with the passage 30 of the valving portion 28. As shown in FIGS. 7 and 8, the walls of the discharge orifice 38 meet the upper surface of the wall 40 of the cap at a circular intersection which is substantially devoid of projections, to thereby enable any excess product to be easily wiped away, following use of the dispenser. At the juncture of the skirt 32 and crown 40, the cap part 24 has a sealing shoulder 41 engageable with the rim of the neck portion 22 for all rotative positions of the cap part on the neck portion, providing a secondary or supplemental seal which prevents product from flowing down into the annular space 33 between the skirt 32 and neck portion 22.

Rotational movement of the cap 24 on the bottle neck 22 is controlled by a pair of stops or detent structures 42, 43 presenting shoulders on the exterior surface of the neck 22, as seen in FIGS. 3 and 4. The stops 42, 43 are located in the space 33, and are cooperable with an internal stop or detent structure 44, FIGS. 6 and 7, presenting opposite shoulders on the inside of the skirt 32 of the cap 24.

When one shoulder of the cap stop 44 engages the cooperable shoulder of the neck stop 43, corresponding to a first predetermined position of the cap 24, the latter is in its maximum-rate discharging position shown in FIG. 9, with the passages 30 and 36 fully in registration, and the discharge orifice 38 is in communication with the interior of the container. When the other or opposite shoulder of the cap stop 44 engages the cooperable shoulder of the neck stop 42, corresponding to a second predetermined position of the cap on the neck portion, the valving device is fully shut off and the cap 24 is in the closed, sealing position. FIG. 5 shows by the dotted outline 45 an intermediate or metering rotative position of the cap 24 wherein the rate of flow of liquid from the bottle 20 is reduced by approximately half; various other positions of the cap 24 give still other fractional rates of flow of the liquid.

When the cap 24 is in the sealing position as shown in FIG. 5, with the said other shoulder of the cap stop 44 disposed against the cooperate shoulder of the neck stop 42, the cap is yieldably held therein by a detent means comprising a back-off detent nib 46 shown in FIGS. 3 and 4 located on a completely cylindrical exterior surface portion of the bottle neck 22; the nib 46 is for this position, engaged by the said one shoulder of the cap stop 44 which is at its edge facing away from the stop 42. The nib provides a frictional detent force which tends to oppose inadvertent movement of the cap from the fully closed position on the neck portion.

The neck stops 42 and 43 have camming edges 49 and 47 respectively to enable a one-way turning by-pass of the cap stop 44, if the cap 24 by some chance is initially misaligned as regards proper location of the stop 44 between the stops 42 and 43.

The underside of the crown 40 of the cap has a plurality of bearing ribs 48 which serve to confine the liquid being discharged through the orifice 38, and to wipe the top edge 25 of the neck 22 clean. The ribs 48 rest or bear on the top edge 25 of the neck and also position the cap thereon. The cap 24 is further positioned by spacer ribs 50 on the lower outside surface of the neck 22. Three such spacer ribs 50 are indicated. The discharge orifice 38 is disposed circumferentially between two of the ribs 48, as shown.

Retention of the cap 24 on the neck 22 is effected by cooperable detent ring formations or abutment structures. The lower portion of the neck 22 has a camming ring 52 which is adapted to be by-passed by a sloped camming ring or flange 54 at the bottom edge of the skirt 32 of the cap. Due to the resilience of the plastic from which the container 20 with its neck 22 and the cap 24 are molded, the cap can be forced down onto the neck and momentarily expanded to effect a by-pass of the flange 54 past the ring 52. The relative final positions of these parts are shown in FIG. 8, wherein a locking retention of the cap is seen to exist while still enabling the cap to be easily and smoothly turned for the dispensing operation.

FIG. 5 shows in dotted outline the positions of the ribs 48 with respect to the discharge passages 30 and 36 for the sealing position of the cap. As the cap is turned counterclockwise from the position shown, the rib 48 which is at the left of the passage 36 will sweep downward past the passage 30 and past the lower end of said passage, clearing any product from the adjoining surface of the rim 25 of the bottle neck 22. Upon reclosing the cap 24, this rib will sweep upward, clearing any product from the rim 25 at the passage 30.

It will now be understood that, with the cap 24 and neck 22 in the positions shown in FIG. 5, an effective and positive sealing of the contents of the bottle 20 is had, being maintained by the detent action of the back-off nib 46 engaged with the stop 44 of the cap. When the cap 24 is turned counterclockwise or in an unscrewing direction as viewed from the top, it will cause the passages 30 and 36 to become aligned, enabling discharge of the contents of the bottle through the orifice 38. FIG. 2 shows the cap's discharge orifice 38 in solid outline, corresponding to an open position; optionally, some type of indicia (not shown) can be provided at the location of the arrow 56, such as the word "OPEN", or an equivalent term. The sealing position of the cap is represented by the dotted outline representation of the discharge orifice 38 in FIG. 2. This closed position of the cap is approximately 90 degrees displaced from the open, discharge position. Optional marking (not shown), for example, "CLOSED" may be included, as desired.

The rate of discharge can be regulated by the extent of the counterclockwise turning of the cap. A rate of approximately one half is obtained when the passage 36 is in the dotted outline position 45 shown in FIG. 5.

The present invention has the advantages of extreme simplicity by virtue of only two molded parts being required, namely the bottle with its integral neck on the one hand, and the cap which is press-fitted onto the neck, on the other hand. As a consequence, the cost of the dispenser is held to a minimum while at the same time a very convenient actuation is had, involving merely twisting or turning of the cap to discharge the liquid, or else to seal the bottle.

The elimination of threads greatly simplifies the molding, as well as eliminating any tendency for hardened or crusted product from being trapped in such threads.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A hand-held dispenser for holding and dispensing grooming liquids, household and cosmetic liquids, comprising in combination:

a) a container having a neck with a top edge, said neck defining a bore through which liquid contents of the container are to be discharged, b) said neck bore having a lower smooth-surfaced bearing portion and in continuation thereof having an upper discharging portion provided with a discharge passage, said neck further having a completely cylindrical exterior surface portion, c) a cap turnably mounted on and having a crown and a depending outer skirt which latter surrounds the said neck of the container, d) said cap having a tubular valving portion disposed inside said outer skirt and extending into the container neck with a snug sliding fit therein within said bearing portion, e) said valving portion having a discharge passage communicating with the interior of the container and adapted to move into and out of registration with the discharge passage of the container neck bore when the cap is turned on the container neck, f) said cap having an orifice which aligns with the discharge passage of the neck bore when both said discharge passages are in registration with each other, g) cooperable shoulder means on the exterior of said container neck and the interior of said cap skirt, limiting the turning movement of said cap past its sealing position, h) cooperable retainer means on the cap skirt and container neck, adapted to bypass each other when the cap is forced axially over the neck so as to retain the cap on the neck, and i) cooperable detent means on the completely cylindrical exterior surface portion of the container neck and on the cap for yieldably holding the cap against rotation from its sealing position on the container neck.

2. A hand-held dispenser as set forth in claim 1, wherein:

a) said detent means comprises a nib on the exterior of the container neck and a shoulder engageable with said nib and located on the inside of the skirt of the cap.

3. A hand-held dispenser as set forth in claim 1, wherein:

a) the said shoulder means comprises a lug on the neck of the container, engageable with the said shoulder on the inside of the skirt of the cap.

4. A hand-held dispenser for holding and dispensing grooming liquids, household and cosmetic liquids, comprising in combination:

a) a container having a neck with a top edge, said neck defining a bore through which liquid contents of the container are to be discharged, b) said neck bore having a lower smooth-surfaced bearing portion and in continuation thereof having an upper discharging portion provided with a discharge passage, c) a cap turnably mounted on and having a crown and a depending outer skirt which latter surrounds the said neck of the container, d) said cap having a tubular valving portion disposed inside said outer skirt and extending into the container neck with a snug sliding fit therein within said bearing portion, e) said valving portion having a discharge passage communicating with the interior of the container and adapted to move into and out of registration with the discharge passage of the container neck bore when the cap is turned on the container neck, f) said cap having an orifice which aligns with the discharge passage of the neck bore when both said discharge passages are in registration with each other, g) cooperable shoulder means on the exterior of said container neck and the interior of said cap skirt, limiting the turning movement of said cap between sealing and discharge positions, h) cooperable retainer means on the cap skirt and container neck, adapted to bypass each other when the cap is forced axially over the neck so as to retain the cap on the neck, and i) scraper means at the underside of the cap, adapted to ride on the top edge of the container neck and scrape off any liquid product from said edge as the cap is turned.

5. A hand-held dispenser for holding and dispensing liquids, comprising in combination:

a) a container having a neck with a top edge, said neck having a bore through which liquid contents of the container are to be discharged, b) a cap and means on the container and cap for mounting the latter for solely turning movement on the neck of the container, said mounting means restraining the cap against axial movement on the container neck, c) said cap having a discharge orifice and having a stopper plug extending into the container neck, d) cooperable valving means on said stopper plug and on the neck of the container, for providing communication between the discharge orifice of the cap and the interior of the container when the cap is turned toward a first position on the container neck, and for blocking communication between the discharge orifice of the cap and the interior of the container when the cap is turned toward a second position on the container neck, e) said mounting means including cooperable abutment structures adapted to bypass each other when the cap is forced axially over the neck so as to retain the cap on the neck, and f) said cap having a plurality of spaced-apart ribs on its underside, slidably engaging the top edge of the container neck to thereby provide a sliding, scraping bearing between the cap and container neck.

6. A hand-held dispenser for holding and dispensing liquids, comprising in combination:

a) a container having a neck with a bore through which liquid contents of the container are to be discharged, said neck further having a completely cylindrical exterior surface portion, b) a cap and means on the container and cap for mounting the latter for solely turning movement on the neck of the container, said mounting means restraining the cap against axial movement on the container neck, c) said cap having a discharge orifice and having a stopper plug extending into the container neck, and d) cooperable valving means on said stopper plug and on the neck of the container, for providing communication between the discharge orifice of the cap and the interior of the container when the cap is turned toward a first position on the container neck, and for blocking communication between the discharge orifice of the cap and the interior of the container when the cap is turned toward a second position on the container neck, e) said mounting means including cooperable abutment structures adapted to bypass each other when the cap is forced axially over the neck so as to retain the cap on the neck, f) said cap having a depending outer skirt, extending around the container neck, g) said skirt having an inner wall surface which is spaced from the said container neck, and h) yieldable detent means on the completely cylindrical exterior surface portion of said container neck, providing a frictional detent force on the skirt which tends to yieldably oppose inadvertent turning of the cap in one direction from a predetermined rotary position on the neck, i) said frictional detent force-providing means being disposed in the space between the skirt and neck.

7. A hand-held dispenser for holding and dispensing liquids, comprising in combination:

a) a container having a neck with a top edge, said neck having a bore through which liquid contents of the container are to be discharged, b) a cap and means on the container and cap for mounting the latter for solely turning movement on the neck of the container, said mounting means restraining the cap against axial movement on the container neck, c) said cap having a discharge orifice and having a stopper plug extending into the container neck, d) cooperable valving means on said stopper plug and on the neck of the container, for providing communication between the discharge orifice of the cap and the interior of the container when the cap is turned toward a first position on the container neck, and for blocking communication between the discharge orifice of the cap and the interior of the container when the cap is turned toward a second position on the container neck, e) said mounting means including cooperable abutment structures adapted to bypass each other when the cap is forced axially over the neck so as to retain the cap on the neck, and f) scraper means at the underside of the cap, adapted to ride on the top edge of the neck and scrape off any liquid product from said edge as the cap is turned.

8. A hand-held dispenser for holding and dispensing liquids, comprising in combination:

a) a container having a neck with a top edge, said neck having a bore through which liquid contents of the container are to be discharged, b) a cap and means on the container and cap for mounting the latter for solely turning movement on the neck of the container, said mounting means restraining the cap against axial movement on the container neck, c) said cap having a discharge orifice and having an outer skirt and a stopper plug forming an annular well, said plug extending into the container neck, and d) cooperable valving means on said stopper plug and on the neck of the container, for providing communication between the discharge orifice of the cap and the interior of the container when the cap is turned toward a first position on the container neck, and for blocking communication between the discharge orifice of the cap and the interior of the container when the cap is turned toward a second position on the container neck, e) said mounting means-including cooperable abutment structures adapted to bypass each other when the cap is forced axially over the neck so as to retain the cap on the neck, and f) said annular well containing a plurality of bearing ribs which slidably and scrapingly engage the top edge of the container neck as the cap is turned.

9. A hand-held dispenser for holding and dispensing liquids, comprising in combination:

a) a container having a neck with a top edge, said neck having a bore through which liquid contents of the container are to be discharged, b) a cap and means on the container and cap for mounting the latter for solely turning movement on the neck of the container, said mounting means restraining the cap against axial movement on the container neck, c) said cap having a discharge orifice and having a stopper plug extending into the container neck, and d) cooperable valving means on said stopper plug and on the neck of the container, for providing communication between the discharge orifice of the cap and the interior of the container when the cap is turned toward a first position on the container neck, and for blocking communication between the discharge orifice of the cap and the interior of the container when the cap is turned toward a second position on the container neck, e) said mounting means including cooperable abutment structures adapted to bypass each other when the cap is forced axially over the neck so as to retain the cap on the neck, and f) said cap having a transverse top wall and a plurality of spaced-apart ribs on the underside of said top wall, said ribs slidably engaging the top edge of the container neck to thereby provide a sliding, scraping bearing between the cap and container neck, g) the discharge orifice of the cap being disposed in the top wall thereof circumferentially between the said spaced-apart ribs.

10. A hand-held dispenser for holding and dispensing grooming liquids, household and cosmetic liquids, comprising in combination:

a) a container having a neck defining a bore through which liquid contents of the container are to be discharged, said neck having a lip and said bore having a discharge passage, b) a cap turnably mounted on said neck and having a discharge passage, and a depending outer skirt which latter surrounds the said neck of the container and is spaced therefrom, to define an annular space therebetween, c) said cap having a valving portion disposed inside said outer skirt and extending into the container neck, d) said valving portion having a discharge passage communicating with the interior of the container and adapted to move into and out of registration with the discharge passage of the container neck bore when the cap is turned on the container neck, e) said cap having an orifice which aligns with the discharge passage of the neck bore when both said discharge passages are in registration with each other, f) cooperable shoulder means on the exterior of said container neck and the interior of said cap skirt, limiting the turning movement of said cap past its sealing position, g) cooperable retainer means on the cap skirt and container neck, adapted to bypass each other when the cap is forced axially over the neck so as to retain the cap on the neck, and h) a plurality of circumferentially displaced spacer ribs disposed on the exterior of the container neck, and in said annular space, said spacer ribs slidably engaging the cap skirt, said spacer ribs being located axially between the lip of the neck and the retainer means of the skirt and neck.

* * * * *